US006164501A

United States Patent [19]

Stradella

[11] Patent Number: 6,164,501

[45] Date of Patent: Dec. 26, 2000

[54] DEVICE FOR DISPENSING A FLUID CONTAINED IN A HERMETICALLY CLOSED CONTAINER

[75] Inventor: Giuseppe Stradella, Camogli, Italy

[73] Assignee: Tebro, Luxembourg

[21] Appl. No.: 09/117,684

[22] PCT Filed: Jan. 31, 1997

[86] PCT No.: PCT/EP97/00416

§ 371 Date: Mar. 22, 1999

§ 102(e) Date: Mar. 22, 1999

[87] PCT Pub. No.: WO97/29028

PCT Pub. Date: Aug. 14, 1997

[30] Foreign Application Priority Data

Feb. 8, 1996 [FR] France ..... 96 01553

[51] Int. Cl.[7] ..... B67O 5/42

[52] U.S. Cl. ..... 222/386

[58] Field of Search ..... 222/129, 145, 222/81, 83, 386; 604/410, 403, 411, 400

[56] References Cited

U.S. PATENT DOCUMENTS

| | | | |
|---|---|---|---|
| 2,367,883 | 1/1945 | Miller . | |
| 3,917,063 | 11/1975 | Chibret et al. | 222/83 |
| 5,409,141 | 4/1995 | Kikuchi et al. | 222/81 |
| 5,423,793 | 6/1995 | Isono et al. | 604/410 |

FOREIGN PATENT DOCUMENTS

| | | |
|---|---|---|
| 554 988 | 8/1993 | European Pat. Off. . |
| 560 390 | 9/1993 | European Pat. Off. . |
| 2 095 445 | 2/1972 | France . |

*Primary Examiner*—Kevin Shaver
*Assistant Examiner*—Thach Bui
*Attorney, Agent, or Firm*—Sughrue, Mion, Zinn, Macpeak & Seas, PLLC

[57] ABSTRACT

A device for dispensing a fluid substance contained in a container (1) provided with an opening has an element (2) that is movable between a rest position in which it closes the opening of the container (1) and an actuated position, a connection between the inside of the container and an expulsion channel (10) for expelling the substance, and an actuator member (6) for moving the element towards its actuated position. The element slides in a sealed manner inside the container so that the substance is expelled via the expulsion channel. The element includes a sealing ball (5) which, in the rest position of the element, cooperates with the element to increase interference between the element and the container, thereby guaranteeing total hermetic closure of the container. The actuator member includes a displacement element (7) for displacing the sealing ball, thereby reducing the interference between the element (2) and the container so that the element moves into the container towards its actuated position with low friction.

13 Claims, 1 Drawing Sheet

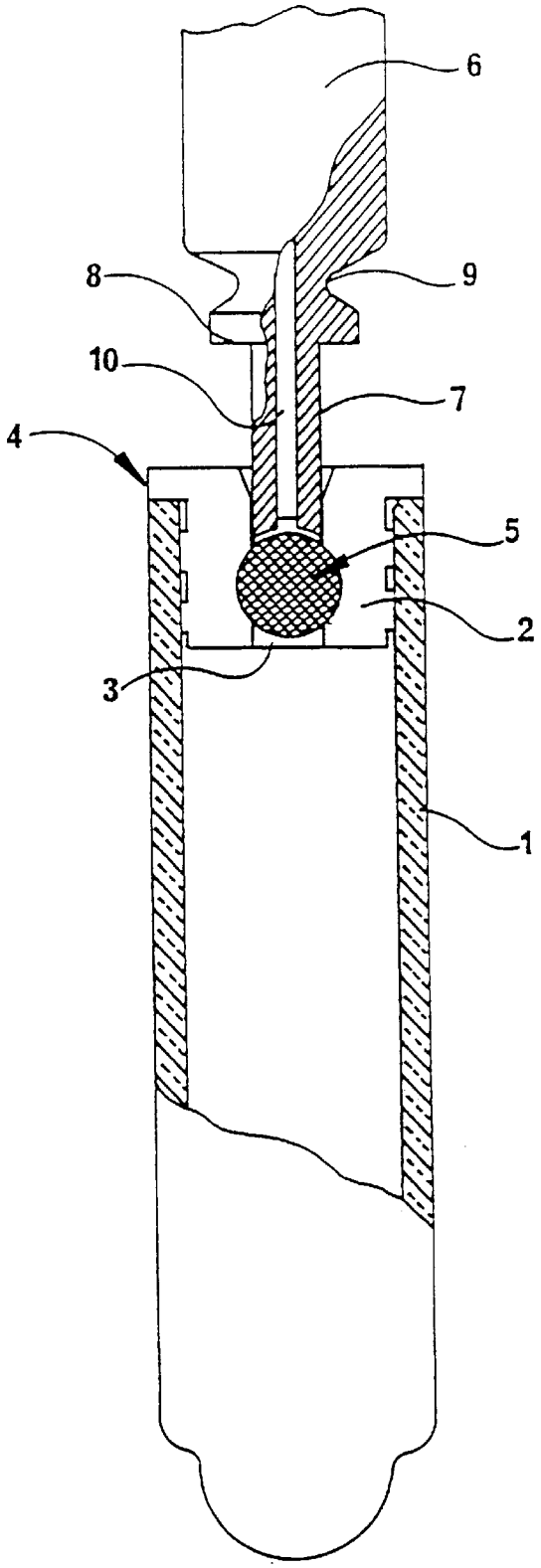
FIG.1
FIG.2
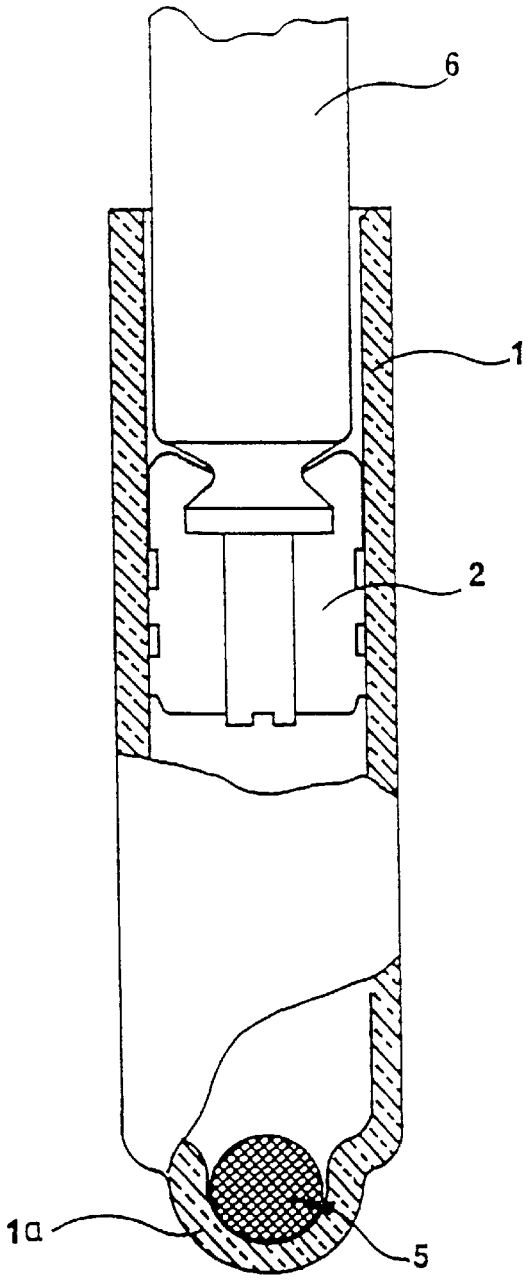

DEVICE FOR DISPENSING A FLUID CONTAINED IN A HERMETICALLY CLOSED CONTAINER

BACKGROUND OF THE INVENTION

The present invention relates to a device for dispensing a fluid, and more particularly a device for dispensing a liquid medicament contained in a hermetically closed container.

In the field of devices for spraying a medicament, and in particular for single-dose devices or for two-dose devices, numerous problems arise. In particular, the most critical problem that is to be solved concerns the stability of the liquid medicament contained in the container of the device.

Between the moment the liquid is put into place in the container of the device, and the moment when it is dispensed, i.e. during the storage period, the liquid tends to evaporate or can be contaminated by external agents such as bacteria, or can be oxidized by oxygen. With certain medicaments, that can cause it to lose its effectiveness completely.

To solve that problem, two types of systems have been used for the most part:

A first type of system comprises a container whose opening is closed by a membrane, said membrane being pierced or torn by appropriate means when the device is actuated. Such systems are described, in particular, in documents EP-0 407 276 and U.S. Pat. No. 4,017,007. The drawback of those membrane devices lies in the fact that the membrane must be applied to the opening of the receptacle with care, thereby requiring a relatively complex assembly step after the container has been filled. Thus, the liquid contained in the container is exposed to possible contamination during the time required for applying said membrane.

In a second type of system, a rubber element used as a pump piston is pierced at the moment of dispenser actuation by a needle which is connected to the spray outlet of the dispenser. One such system is described in document FR-2 684 304. In that type of system, which solves the membrane problem, the size of the piston must be such as to enable it to slide relatively easily in the container. In other words, interference between the piston and the container, i.e. the pressure exerted by the piston against the walls of the container, and consequently the area of contact between those two elements, must be as small as possible in order to avoid problems of friction when the dispenser is being actuated, and also to minimize the force required for actuating the dispenser. This characteristic of little interference means that the amount of protection given against evaporation under certain conditions is limited, for example when storage takes place at high temperatures, and it can also allow the substance to be contaminated, e.g. by the penetration of oxygen.

SUMMARY OF THE INVENTION

An object of the present invention is to provide a device for dispensing a fluid which does not reproduce the above-specified drawbacks.

Thus, an object of the present invention is to provide a device for dispensing a fluid which simultaneously ensures effective and hermetic closure of the container of the substance, and which includes a piston that can slide easily in said container to provide actuation of the dispenser that is safe, reliable, and easy.

The present invention thus provides a device for dispensing a fluid substance contained in a container provided with an opening, said device having an element that is movable between a rest position in which it closes the opening of said container and an actuated position, means for connecting the inside of the container to an expulsion channel for expelling the substance, and an actuator member for moving said element towards its actuated position, said element sliding in sealed manner inside said container so that the substance is expelled via said expulsion channel, the device being characterized in that said element includes sealing means which, in the rest position of the element, co-operate with the element to increase interference between the element and the container, thereby guaranteeing total hermetic closure of the container, said actuator member including displacement means for displacing said sealing means, thereby reducing the interference between the element and the container so that the element moves in the container towards its actuated position with low friction.

Thus, in its rest position, the element acts as a stopper which closes the container hermetically, and when it moves towards its actuated position, it acts as a piston to expel the substance contained in the container.

Advantageously, the actuator member has means for uniting the element and the actuator member after the sealing means has been displaced by said displacement means.

Preferably, said element is substantially cylindrical and has a substantially cylindrical passage connecting the inside of the substantially cylindrical container to said expulsion channel, said sealing means comprising a closure member which closes said passage in sealed manner when the element is in its rest position, said displacement means for displacing said closure member being adapted to open said passage.

Preferably, said closure member has a diameter greater than the diameter of the passage so that, in the rest position of the stopper, it causes the outside wall of the element to be pressed against the inside wall of the container, thereby increasing the interference between the element and the container in said rest position.

Advantageously, said closure member is a ball which is forced into the passage of the element after the container has been filled.

Advantageously, said actuator member has a rod with the expulsion channel passing therealong, said rod being capable of sliding in sealed manner in the passage to displace said closure member.

Advantageously, the end of said rod displaces said closure member from the passage into the container, which container has a recess for receiving said closure member.

Preferably, said element further includes locking means which prevent the element from moving while it is in its rest position, said actuator member further including means for displacing said locking means.

Advantageously, said locking means comprise an annular flange which, in the rest position of the element co-operates with the opening of the container to prevent the element moving in the container.

In a particularly advantageous embodiment of the invention, the actuator member includes, extending the rod, a shoulder whose outside diameter is smaller than the inside diameter of the container, and includes, extending said shoulder, a groove such that when the actuator member is actuated, the rod slides in the passage through the element initially to displace the closure member, after which the shoulder co-operates with the outside radial surface of the element exerting a force thereon which urges said element towards its actuated position, said force being greater than the resilience of the annular flange such that the flange folds around said shoulder into said groove to enable the element to move inside said container.

Preferably, the length constituted by the sum of the radius of the shoulder plus the thickness of the annular flange is approximately equal to the inside radius of the container, such that the element can slide sealingly and with low friction in the container.

Advantageously, said element is made of an elastomer material.

BRIEF DESCRIPTION OF THE DRAWINGS

Other characteristics and advantages of the present invention appear from the following description of an advantageous embodiment of the invention, given by way of non-limiting example with reference to the accompanying drawing, in which:

FIG. 1 is a diagrammatic fragmentary section view of the dispenser device in an advantageous embodiment of the invention, prior to actuation of the device; and FIG. 2 is a view to similar to FIG. 1, during actuation of the device.

DETAILED DESCRIPTION OF THE PREFERRED EMBODIMENT

With reference to the figures, the device of the invention comprises a preferably substantially cylindrical container 1 having an opening. A preferably substantially cylindrical element 2 is disposed in said container 1 and is movable between a rest position as shown in FIG. 1 where it closes the opening of said container 1, and an actuated position as shown in FIG. 2. In its rest position, this element 2 closes the container in totally hermetic manner and consequently prevents any contamination or evaporation of the substance contained in the container 1. In this position, the element 2 thus acts as a stopper. The device also has an actuator member adapted to move said element 2 towards its actuated position, said element 2 sliding in sealed manner inside the container 1 during said displacement and thus acting in this situation as a dispenser piston. The dispenser device also includes means for connecting the inside of the container to a channel 10 for expelling the substance which is connected to the outlet from the dispenser (not shown).

It should be observed that the dispenser device of the present invention can be fitted to any type of substance dispenser in which a substance contained in a hermetically closed container is to be dispensed, e.g. sprayed.

The description below of a preferred embodiment of the invention is therefore very schematic and it is clear that the various elements described can take any appropriate shape to be adapted to any type of substance dispenser.

With reference to FIG. 1, the element 2 is in its rest position in which it acts as a stopper. It is made of a suitable elastomer material, e.g. rubber, and has a passage 3 passing through it axially, preferably in its center. The passage 3 is preferably substantially cylindrical. Immediately after the container 1 has been filled with substance, a closure member 5 is placed in the passage 3 to close the container in totally hermetically sealed manner. Preferably, the closure member 5 is spherical and may be embodied, for example, in the form of a ball of suitable material such as stainless steel. The diameter of the ball 5 is greater than the inside diameter of the passage 3 such that when the ball is placed in said passage 3 it serves both to close the passage and to cause high compression forces to be exerted between the rubber side walls of the element 2 and the container 1. A high degree of interference is thus established between the element 2 and the walls of the container 1, thereby guaranteeing that in its rest position, prior to actuation, the container is closed in effective, leakproof, and totally hermetic manner.

The device also includes an actuator member 6 which has an axially-extending rod 7. Advantageously, the actuator member 6 includes a shoulder 8 extending said rod 7, and a recess 9, e.g. a groove, extending said shoulder 8. The actuator member has the expulsion channel 10 for the substance passing therethrough, preferably axially, which channel is connected firstly to the outlet of the dispenser and secondly opens out to the end of said rod 7. Said rod 7 preferably has a diameter that is very slightly greater than the inside diameter of the passage 3 through the element 2.

The actuator member 6 is connected to an actuator device such as a pushbutton (not shown) for the dispenser.

The element 2 also has locking means, preferably implemented in the form of an annular flange 4 which, in the rest position of the element 2, co-operates with the container 1 to prevent the element 2 from moving in the container. In particular, said annular flange 4 is integral with the element 2 and, in the rest position of the element 2, bears against the top end of the wall of the container 1.

The device operates as follows.

Immediately after the container 1 has been filled with substance, the ball 5 is forced into the passage 3 through the element 2, said element 2 remaining in its rest position at the top end of the container 1 during this operation because of its annular flange 4 which prevents the element 2 from moving in the container 1.

When the device is actuated, the actuator member 6 is moved relative to the container 1 so that the end of the rod 7 pushes the ball 5 out of the passage 3 through the element 2. Thus, when the ball 5 is expelled from the passage 3, it no longer causes any compression force to be exerted between the side walls of the element 2 and the walls of the container 1, so the interference between these two elements is decreased very considerably. The outside diameter of the rod 7 is such that said rod 7 slides in sealed manner in said passage 3, and the length of said rod 7 is such that the shoulder 8, extending the rod 7, comes to bear against the outside radial surface of the element 2 immediately after said ball 5 has been expelled from the passage 3. The force exerted by the shoulder 8 on said outside radial surface of the element 2 urges said element 2 towards its actuated position, thereby causing the annular flange 4 to fold around said shoulder 8 and, where appropriate, to be received in said groove 9 formed above said shoulder 8. Thus, to move the annular flange 4, it suffices that the force exerted by the actuator member 6 on the element 2 is slightly greater than the resilience of said annular flange 4, since the interference between the element 2 and the walls of the container 1 is greatly reduced because the ball 5 is no longer present in the passage 3. In this way, when the device is actuated, energy is accumulated in the finger or arm (corresponding to the resistance of the annular flange). This has the advantageous consequence of improving spraying, since the accumulated energy is released suddenly during spraying. When the actuator member 6 has a groove 9, the interaction between the flange 4 and the groove 9 has the effect of securing the element 2 to the actuator member 6 so that they form a unitary assembly moving as a whole in the container 1.

The diameter of the shoulder 8 is necessarily smaller than the inside diameter of the container 1 so as to allow the dispenser device to be actuated. Preferably, the size of said shoulder 8 is such that the length formed by summing the radius of the shoulder 8 and the thickness of the annular flange 4 is substantially equal to the inside radius of the container 1, such that once the annular flange 4 has folded around the shoulder 8, the outside diameter of the assembly at said shoulder 8 is approximately equal to the inside diameter of the container 1. In this way, the interference between the element 2 and the container 1 is increased very little by the presence of the annular flange 4.

The final folded position of the annular flange 4 thus enables it to penetrate into the container without giving rise to significant friction and thus guarantees that the element 2 and the actuator member 6 co-operate effectively.

At this moment, the element 2 takes up its piston function and can slide in sealed manner inside the container 1 with a very small amount of friction, thereby making it possible to ensure that the dispenser device operates safely, reliably, and easily.

As shown in FIGS. 1 and 2, the container 1 may have a recess in its bottom wall for receiving the closure member 5 after it has been expelled from the passage 3 by the rod 7 of the actuator member 6. When the closure member 5 is a ball, this recess 1*a* is advantageously substantially spherical in shape.

The invention thus makes it possible to guarantee that the substance is sealed immediately after being put into the container and that it remains sealed until it is dispensed throughout the entire duration of storage, regardless of storage conditions, and throughout the entire dispensing process.

Although the above detailed description is given with reference to a single-dose device, the present invention is also applicable to multiple-dose devices.

What is claimed is:

1. A device for dispensing a fluid substance, comprising:

a container (1) in which the substance is contained, said container being provided with an opening, an element (2) movable between a rest position in which it closes the opening of said container and an actuated position, means for connecting the inside of the container to an expulsion channel (10) for expelling the substance, an actuator member (6) for moving said element towards its actuated position in which said element slides in a sealed manner inside said container to expel the substance via said expulsion channel, a passage (3) defined in said element connecting the inside of the container to said expulsion channel, sealing means including a closure member (5) which, in the rest position of the element, co-operates with the element to close said passage in a sealed manner and to establish a high degree of frictional interference between the element and the container to hermetically close the container, and displacement means (7) included with the actuator member for displacing said closure member to open said passage and reduce the interference between the element and the container so that the element can slide in the container towards its actuated position with a low degree of friction.

2. A device according to claim 1, in which the actuator member has means (8, 9) for uniting the element and the actuator member (6) after the closure member has been displaced by said displacement means.

3. A device according to claim 1, in which said container element, and passage are substantially cylindrical.

4. A device according to claim 3, in which said closure member has a diameter greater than the diameter of the passage so that, in the rest position of the element, an outside wall of the element is pressed against an inside wall of the container, thereby increasing the frictional interference between the element and the container in said rest position.

5. A device according to claim 1, in which said closure member is a ball (5) which is forced into the passage through the element (2) after the container has been filled.

6. A device according to claim 1, in which said displacement means is a rod (7) with the expulsion channel (10) passing therethrough, said rod (7) being capable of sliding in a sealed manner in the passage to displace said closure member.

7. A device according to claim 6, in which an end of said rod displaces said closure member from the passage into the container, which container has a recess (1*a*) for receiving said closure member.

8. A device according to claim 6, in which said element (2) further includes locking means (4) which prevent the element from moving while it is in its rest position, said actuator member further including means (8, 9) for displacing said locking means.

9. A device according to claim 8, in which said locking means (4) comprise an annular flange which, in the rest position of the element (2) co-operates with the opening of the container to prevent the element moving in the container.

10. A device according to claim 9, in which the actuator member (6) includes, above the rod (7), a shoulder (8) whose outside diameter is smaller than the inside diameter of the container (1), and includes, above said shoulder, a groove (9) such that when the actuator member is actuated, the rod slides in the passage through the element (2) initially to displace the closure member (5), after which the shoulder co-operates with an outside radial surface of the element exerting a force thereon which urges said element towards its actuated position, said force being greater than the resilience of the annular flange (4) such that the flange folds around said shoulder into said groove to enable the element to move inside said container.

11. A device according to claim 10, in which the length constituted by the sum of the radius of the shoulder (8) plus the thickness of the annular flange (4) is approximately equal to the inside radius of the container, such that the element (2) can slide sealingly and with low friction in the container.

12. A device according to claim 1, in which said element (2) is made of an elastomer material.

13. A device according to claim 1, in which the element constitutes a stopper in the rest position and a dispenser piston in the actuated position.

* * * * *